US005817223A

United States Patent [19]

Maloney

[11] Patent Number: 5,817,223

[45] **Date of Patent: *Oct. 6, 1998**

[54] METHOD OF PRODUCING A FIBER TOW REINFORCED METAL MATRIX COMPOSITE

[75] Inventor: Michael Joseph Maloney, Port St. Lucie, Fla.

[73] Assignee: United Technologies Corporation, Hartsford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 706,369

[22] Filed: Aug. 30, 1996

[51] Int. Cl.[6] ..... C25D 13/02

[52] U.S. Cl. ..... 204/471; 204/479; 204/483; 204/490; 204/512

[58] Field of Search ..... 204/471, 479, 204/483, 490, 512

[56] References Cited

U.S. PATENT DOCUMENTS

| | | | |
|---|---|---|---|
| 2,248,988 | 7/1941 | Hall | 204/512 |
| 4,390,589 | 6/1983 | Geyling et al. | 428/381 |
| 4,806,218 | 2/1989 | Hemminger et al. | 204/180.2 |
| 5,244,748 | 9/1993 | Weeks, Jr. et al. | 428/618 |
| 5,302,265 | 4/1994 | Dalzell, Jr. et al. | 204/181.5 |
| 5,336,381 | 8/1994 | Dalzell, Jr. et al. | 204/180.2 |
| 5,366,687 | 11/1994 | Dalzell, Jr. et al. | 419/35 |
| 5,415,748 | 5/1995 | Emiliani et al. | 204/181.5 |
| 5,468,358 | 11/1995 | Ohkawa et al. | 204/181.5 |

OTHER PUBLICATIONS

Partho Sarkar and Patrick S. Nicholson, Electrophoretic Deposition (EPD): Mechanisms, Kinetics, and Application to Ceramics, pp. 1987–2002 (1996).

J.A. Cross, Elctrostatics: Principles, Problems and Applications, 7 pgs.

Vernon A. Lamb and Walter E. Reid Jr., Electrophoretic Deposition of Metals, Metalloids, and Refractory Oxides, pp. 291–296 Mar. 1960.

Conrado P. Gutierrez, John R. Mosley, and Terry C. Wallace, Electrophoretic Deposition: A Versatile Coating Method, pp. 923–927 Oct. 1962.

J.J. Shyne, H.N. Barry, W.D. Fletcher, H.G. Scheible, Electrophoretic Deposition of Metallic and Composite Coatings, pp. 1255–1258 Oct. 1955.

Brett Wilson, C.J. Suydam, M.J. Crimp and M.A. Crimp and M.A. Crimp, Processing of $FeA1/A1_2O_3$ IMCs Using Advanced Electrodeposition Methods, pp. 891–896 (1993).

*Primary Examiner*—Arun S. Phasge

*Attorney, Agent, or Firm*—Brooks Haidt Haffner & Delahunty

[57] ABSTRACT

A method of producing a fiber tow reinforced metal matrix composite having effective alloy infiltration throughout the tow includes providing a conductive fiber tow comprised of a plurality of individual conductive ceramic fibers; providing an electrode; immersing the tow and the electrode in a slurry including particulates of a metal matrix composite material; applying an electric field between the conductive fiber tow and the electrode, wherein the individual fibers spread open thereby allowing uniform infiltration of the particulates onto the fibers; and consolidating the infiltrated tow.

4 Claims, 1 Drawing Sheet

FIG. 1
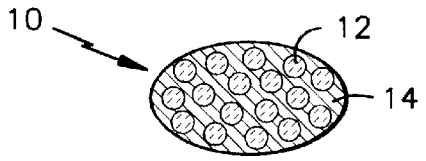
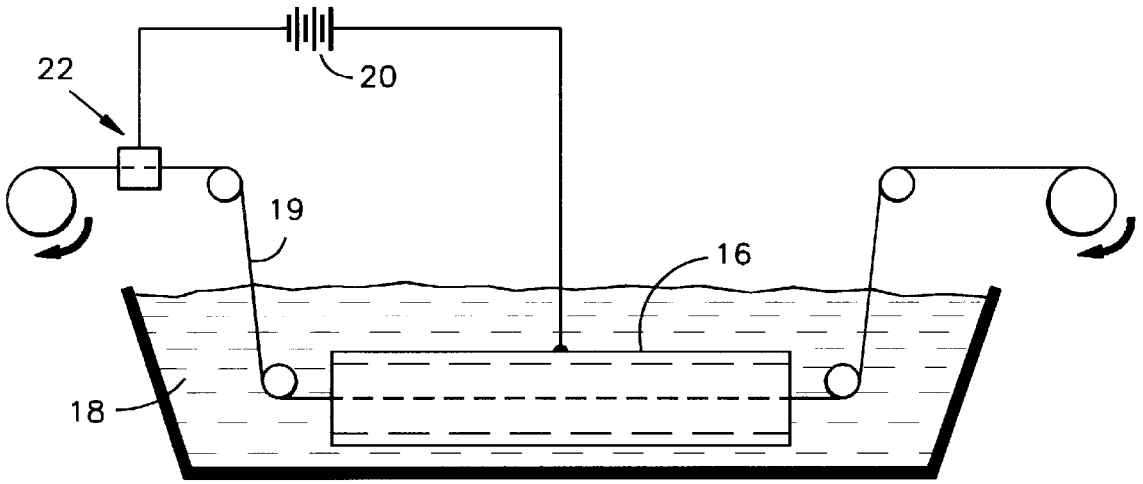
FIG. 2

METHOD OF PRODUCING A FIBER TOW REINFORCED METAL MATRIX COMPOSITE

GOVERNMENT RIGHTS

The present invention was made in part during the performance of work under contract NAS3-26385 and the Government has certain rights therein.

BACKGROUND OF THE INVENTION

1. Technical Field

The present invention relates generally to metal matrix composites and specifically to fiber tow reinforced metal matrix composites and methods of producing such composites.

2. Background Information

Metal matrix composites typically include an alloy matrix reinforced with ceramic fibers. These ceramic reinforced composites exhibit desirable properties such as improved strength, stiffness and creep resistance at high temperatures. Thus, these composites are potentially useful for gas turbine engine applications.

In general, there are two types of ceramic fiber reinforcements, monofilament and tow. Monofilament fibers consist of a single strand of fiber, whereas a tow consists of a bundle of numerous fibers. Generally, individual fibers of a tow bundle are of a significantly smaller diameter than monofilament fibers.

Fiber tow reinforced metal matrix composites are superior to monofilament fiber reinforced metal matrix composites because in the former case, thermal expansion problems are reduced. For example, thermal expansion mismatch exists between the metal matrix and the ceramic fibers because ceramic has a lower coefficient of thermal expansion than metal. Thus, when fiber reinforced composites are heated and cooled, stresses build up around the fibers and cracking of the metal matrix or fiber may result. This cracking problem is minimized with fiber tows because the diameters of the fibers are finer, thereby resulting in reduced local stress. This is a significant advantage of fiber tow reinforced metal matrix composites over monofilament fiber reinforced metal matrix composites.

In addition, due to the large diameter of monofilament fibers, a smaller number of fibers are utilized for a given volume loading as compared to tow fibers. If one monofilament breaks during manufacturing or service a significant portion of the composite strength is lost, whereas if one fiber in a tow breaks, it is less detrimental because many other fibers are available to share the remaining load.

A difficult step in the fabrication of fiber tow reinforced metal matrix composites is effective infiltration of the tow with the matrix alloy. Total infiltration is highly desirable for proper component fabrication. Upon infiltrating the tow with the matrix alloy, the composite is consolidated to make a component by compaction techniques, such as hot isostatic pressing. If the tow is not uniformly infiltrated, voids will result between adjacent fibers. These voids can lead to fiber-fiber contact during the consolidation process which reduces the resulting composite's load carrying capability.

In the past, various methods have been used to infiltrate ceramic fiber tow with an alloy matrix. For example, slurry infiltration is known. Generally, in this process a slurry (thin paste) of a metal powder is made and the tow is drawn through the slurry. The slurry infiltrates into the tow by capillary action. The tow is then removed from the slurry and consolidated. However, this process often results in fiber-fiber contact because of incomplete infiltration.

Another method of infiltrating an alloy into the tow is liquid infiltration. In this process, an alloy is melted and flowed into a fiber tow. Liquid infiltration is useful for production of fiber reinforced aluminum matrix composites because aluminum has a fairly low melting point (about 660° C.) and the fibers can be exposed to such temperatures without degrading. However, this process is not appropriate for high temperature nickel and iron base superalloy composites because of the high melting points of these alloys. The fibers degrade upon exposure to this high temperature molten metal. U.S. Pat. No. 5,244,748 issued to Weeks, Jr. et al. is exemplary of an attempt to provide metal matrix coated fiber composites by liquid infiltration such that the fibers are not degraded during processing. The contents of U.S. Pat. No. 5,244,748 are herein incorporated by reference. Additionally, with liquid infiltration processing there are problems with fiber wettability by the liquid metal.

Other known processes for fabricating metal matrix composites include depositing the alloy on the fibers by physical vapor deposition or by vapor phase coating processes. These coating processes work well for monofilaments because of the ease in which a single fiber may be uniformly coated. No obstructions, such as close adjacent fibers, hinder the coating process. However, if tows are coated in this manner, the fibers on the outer surface of the bundle are preferentially coated. The fibers on the inner surface of the bundle are shielded by the outer fibers, thus, effective coating does not occur. Even if the fibers are manually spread apart by hand, complete infiltration is difficult.

Accordingly, there exists a need for an efficient method of infiltrating a fiber tow bundle with an alloy such that the individual fibers in the tow are uniformly coated with the alloy. This method is needed for the production of a metal matrix composite with effective fiber distribution for high temperature structural applications, such as in gas turbine engine operations.

DISCLOSURE OF INVENTION

The present invention relates to a method of producing a fiber tow reinforced metal matrix composite having effective alloy infiltration throughout the tow.

One aspect of the invention includes providing a conductive fiber tow comprised of a plurality of individual conductive ceramic fibers; providing an electrode; immersing the tow and the electrode in a slurry including particulates of a metal matrix composite material; applying an electric field between the conductive fiber tow and the electrode, wherein the individual fibers spread open thereby allowing uniform infiltration of the particulates onto the fibers; and consolidating the infiltrated tow.

Another aspect of the invention includes a method of infiltrating a fiber tow comprising: immersing a fiber tow in a slurry, the fiber tow including a plurality of individual fibers; and spreading the fibers using an electric field.

An advantage of the present invention is the ability to spread the tow for rapid and thorough infiltration of the tow with a metal matrix material. Other advantages of the present invention include minimal fiber damage during infiltration, uniform infiltration of the tow, and uniform coating of the individual fibers.

These and other features and advantages of the present invention will become more apparent from the following description and accompanying drawings.

BRIEF DESCRIPTION OF THE DRAWINGS

FIG. 1 schematically depicts a cross section of a fiber tow reinforced composite of the present invention.

FIG. 2 schematically depicts an apparatus suitable for use with the present invention.

BEST MODE FOR CARRYING OUT THE INVENTION

A novel method of producing a fiber tow reinforced metal matrix composite having effective alloy infiltration throughout the tow is disclosed. The present invention employs electrophoresis. Electrophoresis generally refers to a process whereby minute particles in a colloidal suspension are exposed to an electric field and thereby caused to migrate to an electrode. Colloids in solution are known to develop a surface charge relative to the suspension medium as a result of mechanisms such as lattice imperfection, ion adsorption, ionization, and ion dissolution. For example, in the case of metal oxides such as alumina, the surface charge is the result of ionization, and is generally positive in a pH range below about 7. During electrophoresis, positively charged colloids migrate to a cathode, forming a layer of particles thereon. For a further discussion of electrophoretic deposition, see Vernon A. Lamb et al., "Electrophoretic Deposition Of Metals, Metalloids, And Refractory Oxides," Plating, vol. 47. No. 3, Mar. 1960, pp. 291–296, the contents of which are herein incorporated by reference.

FIG. 1 schematically depicts a cross-section of a fiber tow reinforced composite 10 of the present invention. According to the present invention, a fiber tow having a plurality of individual, small diameter fibers 12 is provided. A fiber tow may be envisioned as a bundle of yarn. Preferably, the fibers 12 are ceramic because ceramic fibers are less dense than metal fibers and have a greater specific strength than metal fibers. The ceramic fibers 12 may include, but are not limited to, aluminum oxide, silicon carbide or mullite fibers. Preferably, the ceramic fibers 12 have a diameter less than about 5 microns ($5\times10^{-6}$M).

Ceramic fibers arc generally nonconductive, thus, the fibers 12 must be made sufficiently conductive for purposes of the present invention. Preferably, the ceramic fibers 12 are coated with a conductive material including, but not limited to, iron, nickel or copper. The thickness of the coating is preferably just great enough to maintain an electrical charge over the fiber surface. The current subsequently passing through the coating is very low (milliamp range), so one of ordinary skill in the art will appreciate that the electrical conductivity (and thickness) of the coating can be very low. Specifically, the thickness of the coating may be between about a fraction of a micron and about 5 microns ($5\times10^{-6}$m). Preferably, the thickness is about 2 microns ($2\times10^{-6}$m) or less.

The conductive material may be applied to the individual fibers 12 in the tow by a variety of methods. For example, chemical vapor deposition or physical vapor deposition may be employed. However, these methods are not preferred because they are vapor phase deposition processes which may result in non-uniform coating of the individual fibers 12 in the tow. Preferably, a plating process, such as a conventional electroless nickel plating process, is used to uniformly coat the fibers 12 in the tow. Processes suitable for applying the conductive material to the individual fibers 12 are those capable of uniformly depositing pure metals or alloys. Alternatively, the ceramic fibers 12 could possibly contain impurities to make them conductive.

The conductive tow bundle is then placed in a slurry which is preferably a stabilized colloidal slurry. The slurry may be an aqueous or organic liquid comprising a uniform suspension of fine metallic alloy powders. Suitable aqueous and organic liquids include, but are not limited to, water, isopropyl alcohol, ethyl alcohol and nitromethane and mixtures thereof.

The metallic alloy powders infiltrate into the tow and form the metal matrix 14 of the fiber tow reinforced metal matrix composite 10. Thus, the composition of the alloy powders are dependent upon the desired type of metal matrix composite 10. Matrix alloys useful for elevated temperatures are typically complex in chemical nature because the alloys must provide high temperature strength, high temperature creep resistance and high temperature oxidation resistance. Preferably, the diameter of the alloy powders is less than about 10 microns ($1\times10^{-5}$m). The powder size is also controlled by the need to maintain an electrostatic charge strong enough to keep the powder particulates suspended in the slurry.

An electrolyte may be added to the slurry to obtain a particular electrical charge on the alloy particles which stabilizes the slurry. The electrolyte includes, but is not limited to, ammonium alginate, steric acid, and zein. Adsorption of ionic species from the electrolyte onto the alloy particle surfaces provides the electrical charge onto the alloy particles.

An electrode is also immersed in the stabilized slurry. Suitable electrodes include, but are not limited to, platinum, copper, and nickel. The conductive tow immersed in the slurry is exposed to the electrode such that when an electric field is provided, the tow spreads or opens up to allow a uniform electrophoretic coating of the individual conductive fibers by the alloy particles and thereby a uniform infiltration of the tow. Ultrasonic agitation may be employed to aid the migration of the particles.

As shown schematically in FIG. 2, the preferred electrode geometry is a hollow cylinder 16 which is immersed in the slurry 18 and through which the tow 19 is passed. The tow 19 is connected to one terminal of a DC source 20 while the electrode is connected to the other. The fiber tow 19 is electrically connected to one terminal of the power supply by a sliding contact 22. The charge applied to the conductive fibers via the DC source 20 power supply is opposite the electrical charge on the alloy particles. It is this attractive force that causes the subsequent coating of the conductive fibers with the alloy particles.

The opening of the tow 19 occurs as a result of the mutual repulsion of the coated fibers generated by the like charge on each conductive fiber. The coating of the tow 19 with the alloy particles during infiltration occurs due to the attractive force between the oppositely charged conductive fibers and the metal alloy particles in the suspension, the charge on the particles preferably being set by the specific electrolyte additive. Thus, the charged particles suspended in the slurry 18 render the slurry 18 conductive.

Typically, it takes only minutes for effective infiltration of the tow 19 with the metal matrix material 14. Once the tow 19 is thoroughly infiltrated, it may be conventionally processed (consolidated) to make a composite 10 of desired shape.

It should be noted that use of the above described electrolyte is preferred, but not required. For example, alloy particles may become polarized in the electric field established between the fiber tow and the electrode and develop a negative charge at one end and an equal and positive charge at the other end. Under these circumstances the electric field established between the fiber tow and electrode is non-uniform in field strength, with the field strength increasing in a direction toward the fiber tow. The polarized particles will experience a net dipole force in the non-uniform field and will then migrate toward the fiber tow to facilitate fiber coating. Both AC and DC fields may produce motion of uncharged particles. Accordingly, an electrolyte may not be needed to charge the particles if an electric dipole is induced in the particles and the electric field is non-uniform. For a discussion of dielectrophoresis, see "Electrostatics: Principles, Problems and Applications," Jean Cross, published by Adam Hilger, 1987, pp. 269–276, the contents of which are herein incorporated by reference.

The present invention will now be described by way of examples which are meant to be exemplary rather than limiting.

EXAMPLE 1

An aluminum oxide fiber tow reinforced Fe-Cr-Al alloy metal matrix composite was fabricated according to the present invention. The reinforcement consisted of a nickel coated aluminum oxide fiber tow with a fiber diameter of 12 micrometers and a fiber count of 110. The matrix alloy to be infiltrated consisted of MA 956 alloy powder with a maximum particulate diameter of 10 micrometers. MA 956 high temperature transition metal alloy (Fe-Cr-Al based oxide dispersion strengthened alloy) is supplied by INCO International, Hereford, GB.

The slurry was prepared by combining 140 milliliters of deionized water, 0.3 weight percent ammonium alginate, and 0.25 weight percent polyvinyl alcohol. To this mixture 7.5 grams of MA 956 alloy powder was added. The pH of the slurry mixture was adjusted to between about 9 and 10 by addition of sodium hydroxide and hydrochloric acid.

The voltage applied between the conductive fiber and the hollow, cylindrical platinum reference electrode was set at 2 volts. The current was 4 milliamps. The infiltration time for a section of the tow bundle as it passed through the electrode was 3.5 minutes. Infiltration time is dependent upon fiber count and fiber diameter. The infiltration was carried out at room temperature. The significance of this trial is that the combination of fiber and powder matrix characteristics and processing parameters resulted in effective penetration of the tow bundle by the suspended alloy powder in the slurry.

EXAMPLE 2

An aluminum oxide fiber tow reinforced $MoSi_2$ matrix composite was fabricated according to the present invention. The reinforcement consisted of a copper coated aluminum oxide fiber tow with a fiber diameter of 12 micrometers and a fiber tow count of 110. The matrix alloy to be infiltrated consisted of $MoSi_2$ powder with a maximum particulate diameter of 10 micrometers.

The slurry was prepared by combining 140 milliliters of deionized water and 0.25 weight percent polyvinyl alcohol. To this mixture 7.5 grams of $MoSi_2$ powder was added. The pH of the slurry mixture was adjusted to between about 9 and 10 by addition of sodium hydroxide and hydrochloric acid. The voltage applied between the conductive fibers and the hollow, cylindrical platinum reference electrode was 1 volt. The current was 1 milliamp. The infiltration time for a section of the tow bundle as it passed through the electrode was 8.5 minutes. The infiltration was carried out at room temperature. Ultrasonic agitation of the slurry bath was carried out during infiltration to facilitate transport of the alloy powder.

As in example 1, the combination of fiber and powder matrix characteristics and processing parameters resulted in effective penetration of the tow bundle by the suspended alloy powder in the slurry. The use of ultrasonic agitation aided the infiltration process such that the addition of ammonium alginate was not required for effective infiltration of the tow bundle by the matrix powder.

An advantage of the present invention is the ability to open up a tow for rapid and thorough infiltration of the tow with a metal matrix composite material. Yet another advantage of the present invention is that it is particularly useful for production of fiber reinforced, nickel and iron base superalloy matrix composites.

Other advantages of the present invention includes minimal fiber damage during infiltration, infiltration at ambient temperature, uniform infiltration of the tow, and uniform coating of the individual fibers.

The invention is not limited to the particular embodiments shown and described herein. Various changes and modifications may be made without departing from the spirit or scope of the claimed invention.

I claim:

1. A method of producing a fiber tow reinforced metal or intermetallic matrix composite comprising:

a. providing a plurality of ceramic fibers;

b. coating the ceramic fibers with a conductive material thereby forming a conductive fiber tow having individual conductive fibers;

c. providing an electrode;

d. immersing the tow and the electrode in a slurry including particulates of a metal or intermetallic matrix composite material, said particulates having a melting point and an electrical charge;

e. creating an electric field between the conductive fiber tow and the electrode by applying a like charge to the individual conductive fibers which is opposite the electrical charge on the particulates such that the individual fibers spread and the particulates uniformly infiltrate onto the fibers to produce an infiltrated tow, wherein infiltration is at a temperature below the melting point of the particulates; and f. consolidating the infiltrated tow to produce a fiber tow reinforced metal or intermetallic matrix composite suitable for gas turbine engine operations.

2. A fiber tow reinforced metal or intermetallic matrix composite article made by the method of claim 1, said composite article consisting essentially of a plurality of ceramic fibers coated with a conductive material to form a conductive tow, said conductive tow being uniformly infiltrated with particulates selected from the group consisting of a nickel base and iron base superalloy material, Fe-Cr-Al based oxide dispersion strengthened alloy and molydisilicide.

3. A method of infiltrating a fiber tow comprising: immersing a fiber tow in a slurry, the fiber tow including a plurality of individual ceramic fibers coated with a conductive layer of material; and spreading the fibers using an electric field, wherein particulates having a melting point infiltrate into the tow at a temperature below the melting point of the particulates and form a metal or intermetallic matrix for a fiber tow reinforced metal or intermetallic matrix composite suitable for gas turbine engine operations.

4. A method of infiltrating a fiber tow with a powder comprising the steps of:

a. applying an electrically conductive coating on individual ceramic fibers of the fiber tow, thereby producing a conductive fiber tow;

b. providing a stabilized colloidal slurry comprising a uniform suspension of fine powders having an electrical charge, said powders selected from the group consisting of a nickel base and iron base superalloy material, Fe-Cr-Al based oxide dispersion strengthened alloy and molydisilicide;

c. immersing an electrode in the slurry;

d. immersing the conductive fiber tow in the slurry; and e. creating an electric field between the conductive fiber tow and the electrode by applying a charge to the conductive fiber tow which is opposite the electrical charge on the powders such that the individual fibers spread to allow a uniform electrophoretic coating of the individual fibers by the powders and a uniform infiltration of the tow, wherein infiltration is at a temperature below the melting point of the powders.

* * * * *